US011633674B2

(12) United States Patent
Nevgi

(10) Patent No.: US 11,633,674 B2
(45) Date of Patent: Apr. 25, 2023

(54) TOY CONSTRUCTION ELEMENT

(71) Applicant: Trimiti Moebius Design Pty Ltd, Mount Waverley (AU)

(72) Inventor: Umesh Vinayak Nevgi, Mount Waverley (AU)

(73) Assignee: TRIMITI MOEBIUS DESIGN PTY LTD, Mount Waverley (AU)

( * ) Notice: Subject to any disclaimer, the term of this patent is extended or adjusted under 35 U.S.C. 154(b) by 485 days.

(21) Appl. No.: 16/324,883

(22) PCT Filed: Aug. 10, 2017

(86) PCT No.: PCT/AU2017/050843
§ 371 (c)(1),
(2) Date: Feb. 11, 2019

(87) PCT Pub. No.: WO2018/027272
PCT Pub. Date: Feb. 15, 2018

(65) Prior Publication Data

US 2021/0283523 A1 Sep. 16, 2021

(30) Foreign Application Priority Data

Aug. 12, 2016 (AU) ..... 2016903193

(51) Int. Cl.
*A63H 33/08* (2006.01)
*A63H 33/06* (2006.01)

(52) U.S. Cl.
CPC ..... *A63H 33/086* (2013.01); *A63H 33/062* (2013.01)

(58) Field of Classification Search
CPC ..... A63H 33/086; A63H 33/062
See application file for complete search history.

(56) References Cited

U.S. PATENT DOCUMENTS 3,566,531 A * 3/1971 Hasel ..... A63H 33/062 446/120
3,577,671 A * 5/1971 Woollett ..... A63H 33/086 446/124

(Continued)

FOREIGN PATENT DOCUMENTS

CN 2221433 Y 3/1996
CN 1205239 A 1/1999

(Continued)

OTHER PUBLICATIONS

ISA Australian Patent Office, International Search Report Issued in Application No. PCT/AU2017/050843, dated Oct. 23, 2017, WIPO, 2 pages.

*Primary Examiner* — Eugene L Kim
*Assistant Examiner* — Matthew B Stanczak
(74) *Attorney, Agent, or Firm* — Alleman Hall Creasman & Tuttle LLP

(57) ABSTRACT

A toy construction element is disclosed having a body with at least one projection extending therefrom and a plurality of complementary-shaped recesses formed therein. The recesses extend along at least two different axes and are configured for receiving a corresponding projection from like elements so as to allow like construction elements to be interconnected in three dimensions. The projections and/or recesses may be formed with snap-fit interlocking features whereby the element is configured for interlocking engagement with like elements. The snap-fit interlocking features can include complementary locking formations formed on each projection and each recess. The formations are configured to pass over each other as the projection of one element is received in the recess of another element when like elements are assembled, and the recess is at least in part (Continued)

defined by a resilient component that flexes to resist passage of the formations during assembly and disassembly.

7 Claims, 16 Drawing Sheets

(56) References Cited

U.S. PATENT DOCUMENTS

| | | | | |
|---|---|---|---|---|
| 4,129,960 | A | 12/1978 | Gale | |
| 4,624,647 | A | 11/1986 | Munnix | |
| 5,000,713 | A * | 3/1991 | Cheng | A63H 33/06 446/128 |
| 5,853,314 | A * | 12/1998 | Bora | A63H 33/086 446/120 |
| 6,050,873 | A | 4/2000 | Reisman | |
| 6,086,444 | A * | 7/2000 | Glickman | A63H 33/08 446/120 |
| D464,682 | S * | 10/2002 | Lin | D21/499 |
| 6,616,499 | B1 | 9/2003 | Sorensen | |
| 7,596,473 | B2 * | 9/2009 | Hansen | G06Q 10/06 446/85 |
| 8,801,491 | B2 | 8/2014 | Bruder | |
| 8,986,012 | B1 * | 3/2015 | McGee | A63H 33/08 434/211 |
| D903,778 | S * | 12/2020 | Nevgi | A63H 33/062 D21/479 |
| 2002/0058456 | A1 * | 5/2002 | Miller | A63H 33/084 446/85 |
| 2005/0191932 | A1 * | 9/2005 | Lin | A63H 33/086 446/85 |
| 2009/0298382 | A1 * | 12/2009 | Ochi | A63H 33/086 446/121 |
| 2011/0039474 | A1 | 2/2011 | Bruder | |
| 2014/0262896 | A1 * | 9/2014 | Ficko | B65D 21/0202 206/457 |
| 2014/0378022 | A1 * | 12/2014 | Muthyala | A63H 33/06 446/91 |
| 2014/0378023 | A1 * | 12/2014 | Muthyala | A63H 33/042 446/91 |
| 2016/0008727 | A1 * | 1/2016 | Schindler | G06F 3/04815 715/702 |
| 2016/0279534 | A1 * | 9/2016 | Chang | A63H 33/065 |
| 2019/0299088 | A1 * | 10/2019 | Nevgi | A63F 9/1208 |
| 2020/0054957 | A1 * | 2/2020 | Chan | A63H 33/08 |
| 2020/0246717 | A1 * | 8/2020 | Zen | A63H 33/062 |
| 2021/0170296 | A1 * | 6/2021 | Gregersen | A63H 33/088 |

FOREIGN PATENT DOCUMENTS

| | | | |
|---|---|---|---|
| CN | 101890244 | A | 11/2010 |
| CN | 101991959 | A | 3/2011 |
| JP | S53147994 | U | 11/1978 |
| JP | H0727994 | Y2 | 6/1995 |
| JP | 2015123231 | A | 7/2015 |
| TW | 201247292 | A | 12/2012 |
| WO | 9322018 | A1 | 11/1993 |
| WO | 2006059527 | A1 | 6/2006 |
| WO | 2013080206 | A1 | 6/2013 |

* cited by examiner (Section C-C)

(Section D-D)

(Section E-E)

(Section F-F)

(Section G-G)

(Section H-H)

TOY CONSTRUCTION ELEMENT

CROSS REFERENCE TO RELATED APPLICATIONS

This application is a national phase of and claims priority to International Application No. PCT/AU2017/050843, filed Aug. 10, 2017 and entitled TOY CONSTRUCTION ELEMENT, which in turn claims priority to Australian Patent Application No. 2016903193, filed Aug. 12, 2016 and entitled TOY CONSTRUCTION ELEMENT, the entirety of each of which are hereby incorporated herein by reference for all purposes.

FIELD OF THE INVENTION

The present invention relates to a toy construction element, such as for example a construction toy block or brick or an element used in the construction of model structures.

BACKGROUND OF THE INVENTION

Construction toys are widely popular with children and adults alike. Users are constantly looking for new projects and it is desirable to provide new toy construction elements so that new and unique items can be built.

Previous construction elements have generally been limited to bricks and many previous construction bricks have provided only a weak interlock between like parts, making them susceptible to disengagement, particularly once well used and worn. Accordingly, it is also desirable to provide a toy construction brick with strong interlocking features that resist disengagement.

Previous construction elements have also been limited to construction in only one direction, typically the vertically upwards direction (i.e. one element on top of another element). This limits the variety of model structures possible.

Examples of the invention seek to solve, or at least ameliorate, one or more disadvantages of previous toy construction bricks.

SUMMARY OF THE INVENTION

According to one aspect of the present invention, there is provided a toy construction element having a body with at least one projection extending therefrom and at least one complementary-shaped recess formed therein, the or each projection and the or each recess being formed with complementary locking formations configured such that, when the element is assembled to a further like element by engagement of a projection of one element in a recess of the other element, the formations contact and pass over each other, wherein the recess is at least in part defined by a resilient component, the resilient component flexing to resist passage of the formations over one another to resist assembly and disassembly.

According to a preferred embodiment of the present invention, the element is configured so that the resilient component is stressed as the formations pass over each other and substantially relieved of stress otherwise, the formations being positioned so that the resilient component is substantially relieved of stress when like elements are fully interconnected.

Preferably, the formation of each projection is formed near a tip or distalmost point thereof and the formation of each recess is formed near an outermost point thereof. The formations may be generally annular.

According to another aspect of the present invention, there is provided toy construction element having a body with at least one projection extending therefrom and a plurality of complementary-shaped recesses formed therein, the recesses extending along at least two different axes and being configured for receiving a corresponding projection from like elements so as to allow like construction elements to be interconnected in three dimensions.

This element may be configured for interlocking engagement with like elements.

Preferably, the projections and/or the recesses are formed with snap-fit interlocking features. The snap-fit interlocking features can include complementary locking formations formed on each projection and each recess, the formations configured to pass over each other as the projection of one element is received in the recess of another element when like elements are assembled, wherein the recess is at least in part defined by a resilient component, the component flexing to resist passage of the formations during assembly and disassembly.

The element is preferably configured so that the resilient component is stressed as the formations pass over each other and substantially relieved of stress otherwise, the formations being positioned so that the resilient component is substantially relieved of stress when like elements are fully interconnected.

The described elements may be in the form of a cuboid or rectangular prism, and may be formed of a plurality of integrally formed cubes, each external surface of the cubes having a projection or recess formed thereon.

BRIEF DESCRIPTION OF THE DRAWINGS

Preferred embodiments of the invention will be further described, by 'way of non-limiting example only, with reference to the accompanying drawings in which.

DETAILED DESCRIPTION

Figure 1:
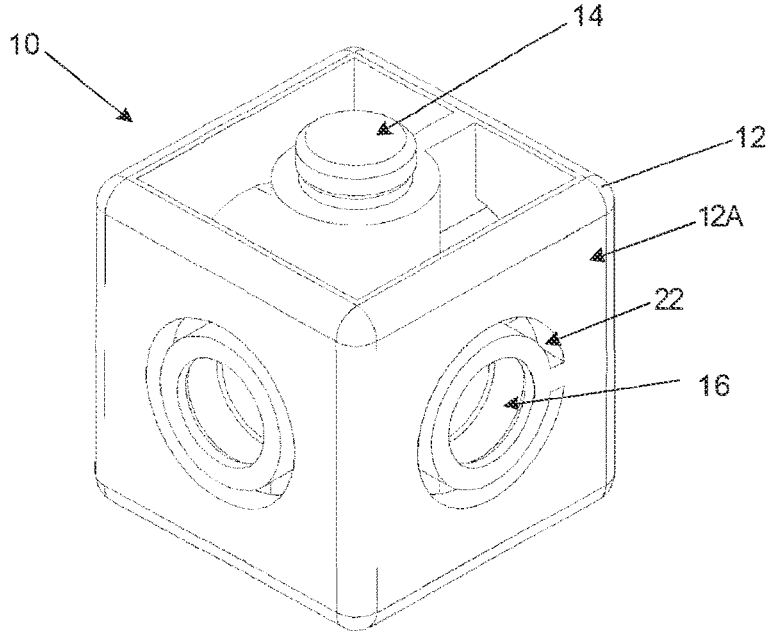
FIG. 1 is a 3D orthographic view of a toy construction element of one embodiment of the invention.

With reference to FIG. 1, there is shown a toy construction element 10 according to a preferred embodiment of the present invention. The element 10 is configured for engaging like elements 10 to form an assembly.

The element 10 has a body 12 with at least one projection 14 extending therefrom and at least one complementary-shaped recess 16 formed therein. The sides of the body 12 comprise substantially planar faces 12A. In the embodiment illustrated in FIG. 1, a single projection 14 and five recesses 16 are provided, though other embodiments are described further below.

Figure 2:
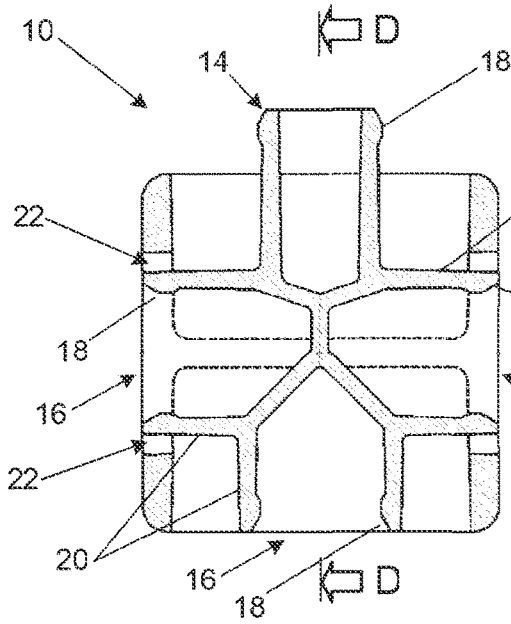
FIGS. 2 and 3 are sectional views of the element of FIG. 1.
Figure 3:
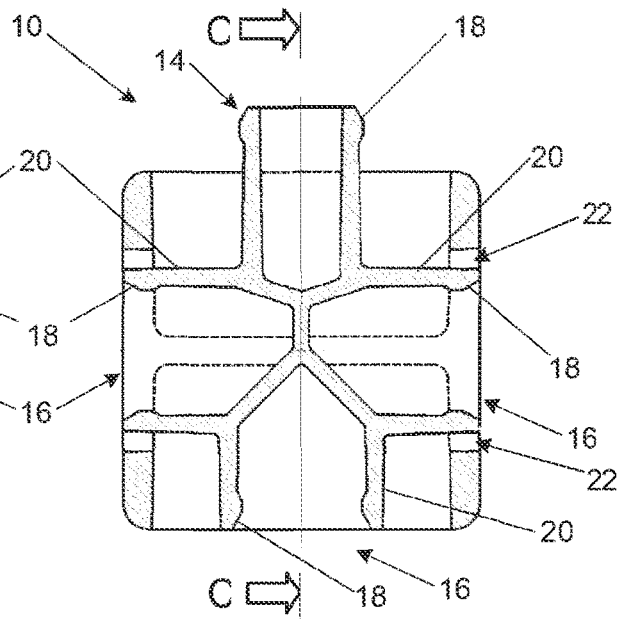

As more clearly illustrated in FIGS. 2 and 3, the projection 14 and each recess 16 is formed with a complementary locking formation in the form of a bulge 18 on a surface thereof. In this regard, the projection 14 has an outwardly extending bulge 18 formed on an outer surface and each recess 16 has an inwardly extending bulge 18 extending from an inner surface of each recess 16. The bulges 18 are configured to contact and pass over each other as the projection 14 of one element 10 is received in the recess 16 of another like element. Each recess 16 is a substantially hollow cylindrical form defined by an elongate cylindrical wall that extends from a common interior location of the body 12 to a level of a respective substantially planar face 12A and is at least partially spaced apart from the substantially planar face. To improve retention of the interconnection between like elements 10, the cylindrical wall of each recess 16 is at least in part defined by a resilient component 20. A space 22 is provided radially outward of the cylindrical wall that at least partially surrounds and separates the cylindrical wall from the substantially planar face 12A. For at least one recess 16, the space 22 is a continuous ring-shaped space. The resilient component 20 of the recess 16 flexes into the space 22 to allow passage of the bulges 18 over one another during connection of like elements 10 and to resist disconnection of like elements 10.

In an alternative embodiment, the projection 14 may be provided with the resilient component 20. In another alternative embodiment, the projection 14 and the recess 16, both, may be provided with the resilient component 20.

The element 10 is configured so that the resilient component 20 is stressed as the bulges 18 pass over each other and substantially relieved of stress otherwise. As the projection 14 of one element 10 is received in the recess 16 of a like element 10, the resilient component 20 is stressed and flexes to allow passage of the formations over each other. Once engaged and the formations have passed over each other, the resilient component 20 is at least substantially relieved of stress. To remove interlocked elements 10 from each other, the resilient component 20 is stressed while separating the elements 10 and this stress is released once separated.

The bulges 18 are positioned so that the resilient component 20 is substantially relieved of stress when like elements 10 are fully interconnected. Fully interconnected is intended to mean that a projection 14 is fully received in a corresponding recess 16 so that like elements 10 are engaged in a home position wherein opposed faces of elements 10 are in contact or close proximity to each other. In the illustrated embodiment, the bulge 18 of each projection 14 is formed near a distalmost point thereof and the bulge 18 of each recess 16 is formed near an outermost point thereof, i.e. away from an innermost point or bottom of the recess 16. In an alternative form, a bulge 18 may not be provided on either the recess 16 or the projection 14 and instead a groove may be provided at a location adjacent the location where the bulge is presently illustrated, for receipt of the bulge 18 of the corresponding recess 16 or projection 14, The described arrangement provides resistance for retaining like elements 10 together without the resilient component 20 being under substantially permanent strain or in a substantially constant state of stress, which can lead to fatigue and reduced retention performance over time. The projection 14 may also or alternatively be sized so as to be complementary-shaped with the recess 16 in a close fitting manner so as to provide some frictional engagement to resist disconnection between like elements 10.

In the forms illustrated, the projections 14 take a. generally hollow cylindrical form with a radial bulge 18 formed near a distal end. The recesses 16 are similarly of a generally hollow cylindrical form with a radial bulge 18 formed near an outermost end.

In the illustrated embodiments, the bulges 18 are generally annular, though it will be appreciated that they may take other forms and may, for example, be made up of a plurality of individual elements or protuberances.

The described projections 14 and recesses 16 provide snap-fit interlocking features, though it will be appreciated that in some embodiments, the element 10 is formed without such features. For example, the element may simply have a body with at least one projection extending therefrom and a plurality of complementary-shaped recesses formed therein, the recesses extending along at least two different axes and being configured for receiving a corresponding projection from like elements so as to allow like construction elements to be interengaged in three dimensions. Such an embodiment may also be provided with snap-fit interlocking features or complementary locking formations of the above described type.

Figure 4:
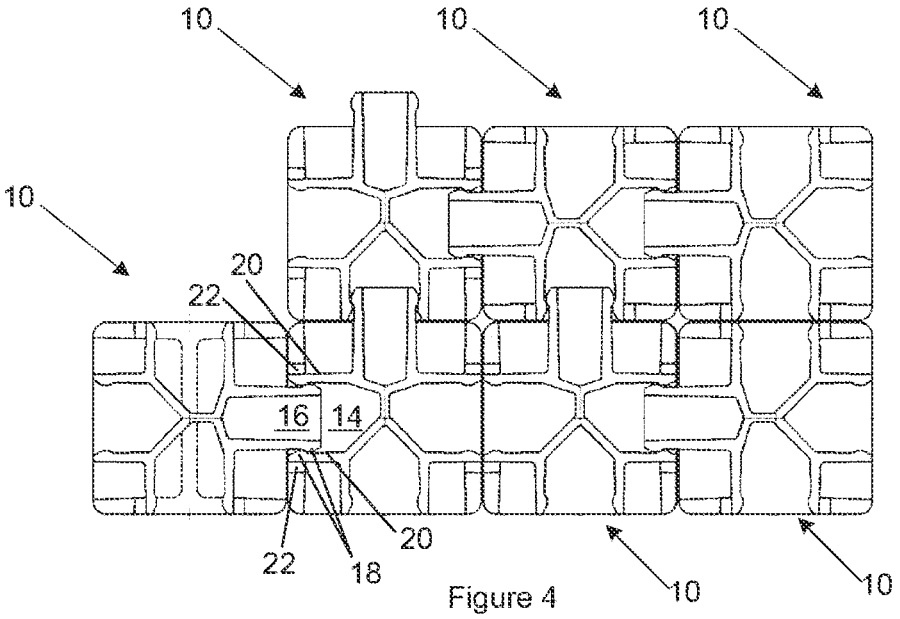
FIG. 4 is a sectional view of a plurality of interengaged elements, each element being in accordance with that of FIGS. 1, 2 and 3.

The element 10 allows for a plurality of like elements 10 to be interconnected or assembled into a construction, as illustrated in FIG. 4.

Figure 5:
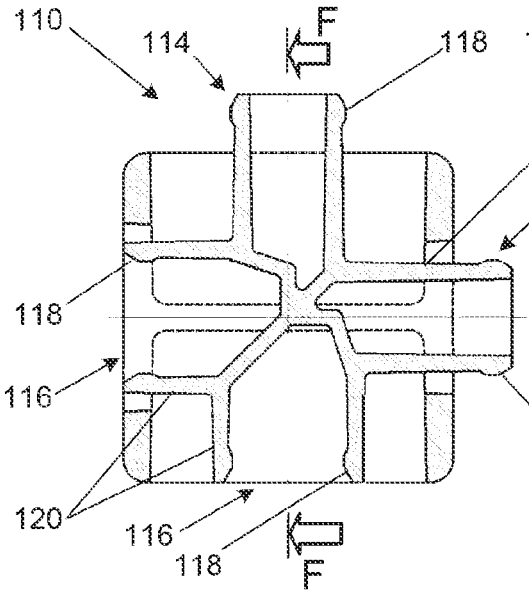
FIGS. 5 and 6 are sectional views of a toy construction element of another embodiment of the invention.
Figure 6:
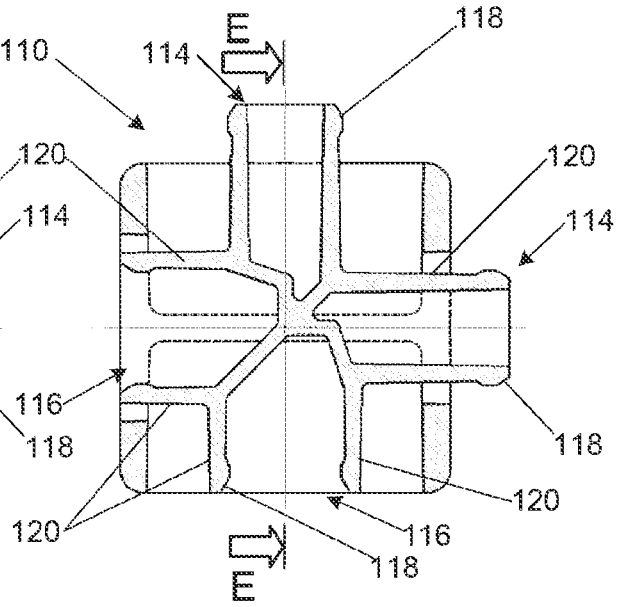

For amusement or convenience, or to enable more complex structures to be assembled, the element may be provided with a different number of projections, as illustrated in FIGS. 5 and 6, In this regard, it can be seen that element 110 is formed with three projections 114 and three recesses 116.

Figure 7:
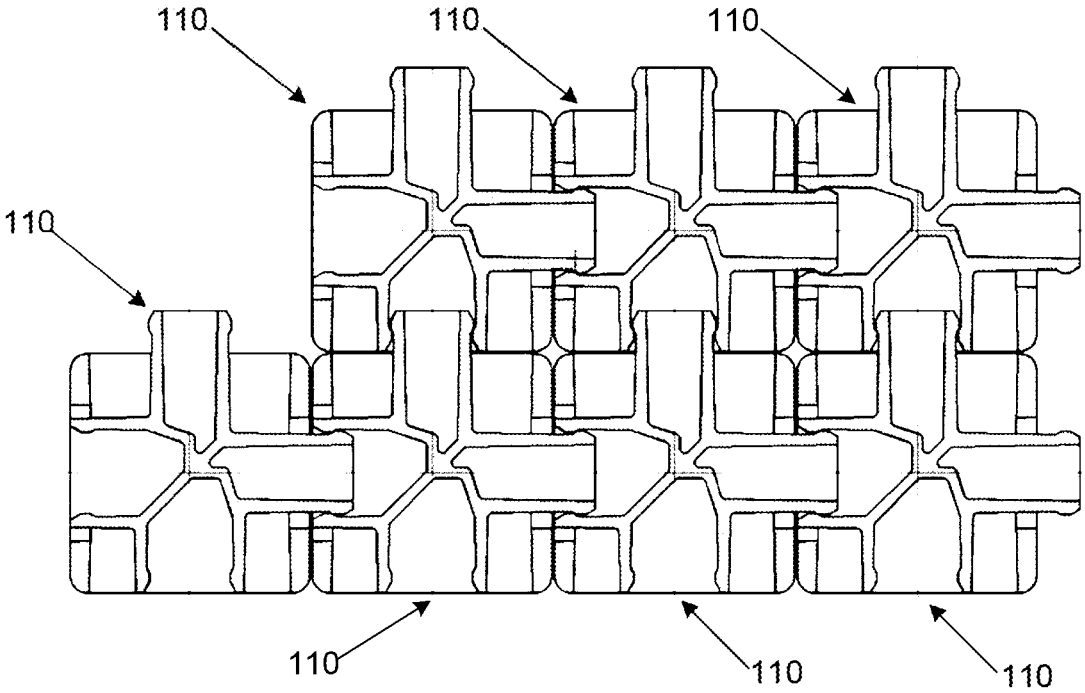
FIG. 7 is a sectional view of a plurality of interengaged elements, each element being in accordance with that of FIGS. 5 and 6.

A plurality of like elements 110 can also be interconnected or 10 assembled into a construction, as illustrated in FIG. 7.

The projections 114 and recesses 116 of element 110 may be provided with complementary locking formations in accordance with those described above.

It will be appreciated that other configurations of elements are also possible, such as one having two projections and four recesses or four projections and two recesses.

Alternatively, at least one of the faces of the element may be without a. projection or recess and may be blank, provided with an alternative structural connection, or simply provided with a. decorative feature.

It will also be appreciated that the body of the element can take many forms. In the embodiments illustrated, the body is in the form of a rectangular prism or a cuboid, i.e. a solid which has six rectangular faces at right angles to each other. The body may or may not have rounded edges. The body may be a rectangular cuboid or a square cuboid. In other embodiments, the body may take other geometric shapes, some of which will be regular and others not. For example, the shape may be selected from a group including, but not limited to, a parallelepiped, a sphere, a pyramid, a prism, a cone, a cylinder and a torus.

Although the embodiments illustrated in FIGS. 1 to 7 have a single projection 14 or recess 16 on each face, the element may also have multiple projections 14 or recesses 16 or a combination thereof on each face. To facilitate this, the body of the element may be a rectangular cuboid and may also be formed of a number of integrally formed elements.

FIGS. 8 to 11 illustrate an embodiment where element 210 is generally of the size of two elements similar to those illustrated in FIG. 1 above. In this regard, element 210 is formed of a plurality of integrally formed cubes, each external surface of the cubes having at least one projection 214 or recess 216 formed thereon.

Figure 8:
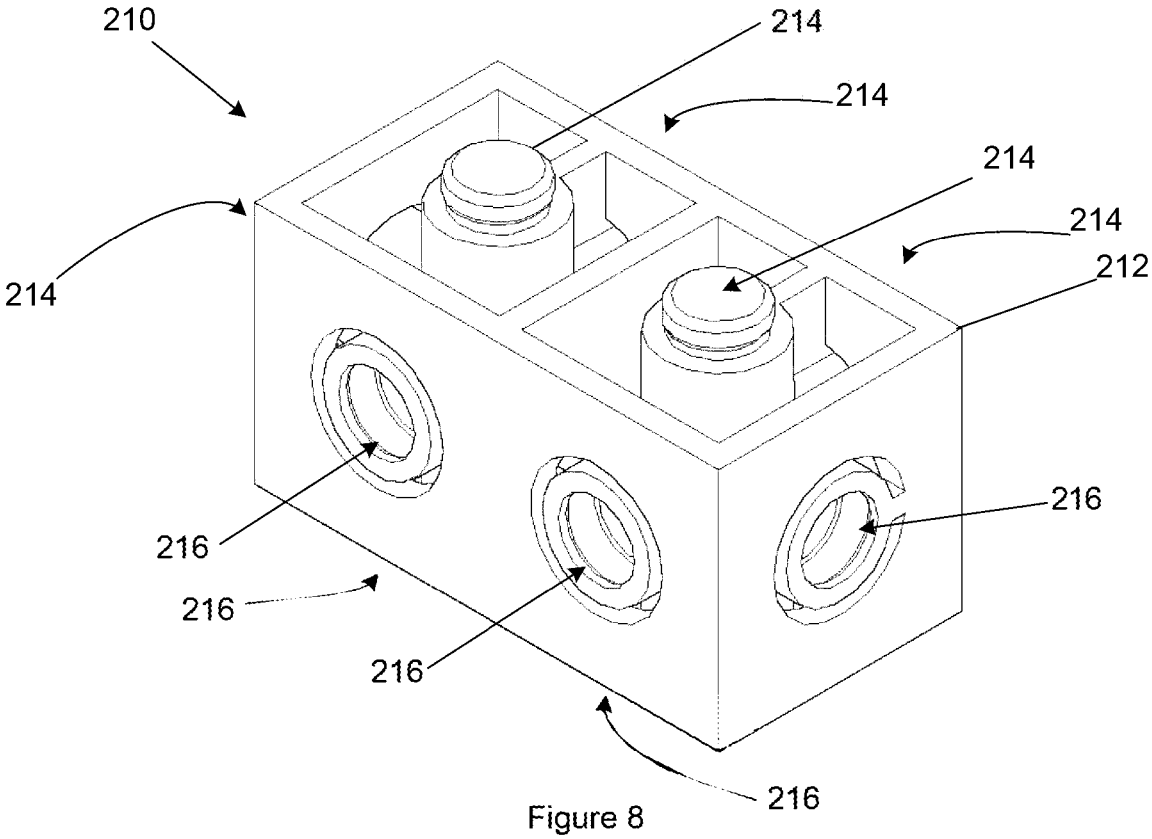
FIG. 8 is a 3D orthographic view of a toy construction element of another embodiment of the invention.

Element 210 has two projections 214 on the surface which is illustrated uppermost in FIG. 8, two recesses 216 on a surface which is illustrated lowermost in FIG. 8 (not shown), two recesses 216 on one major side, two projections 214 on the other major side (not shown), a single projection 214 on one end (not shown) and a single recess 216 on the other end, for a total of five projections 214 and five recesses 216. In other embodiments, the number of projections 214 and recesses 216 may vary.

The projections 214 and recesses 216 of element 210 may be provided with complementary locking formations in accordance with those described above.

Figure 9:
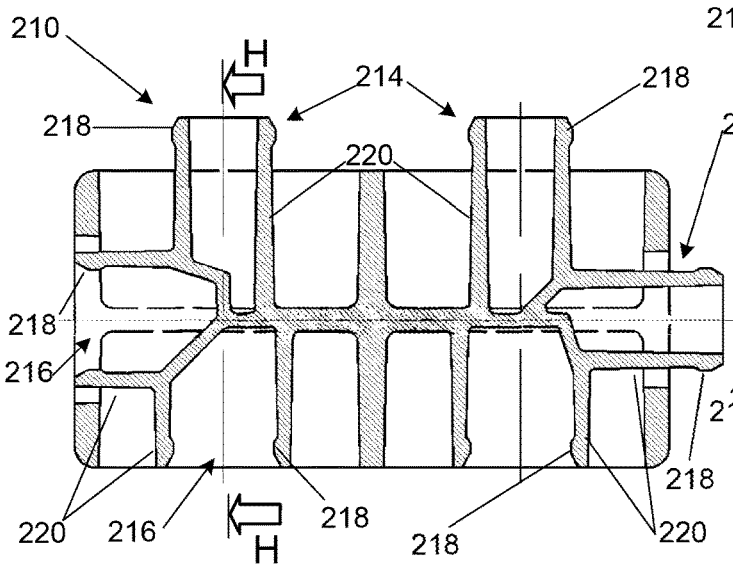
FIGS. 9 and 10 are sectional views of the toy construction element of FIG. 8.
Figure 10:
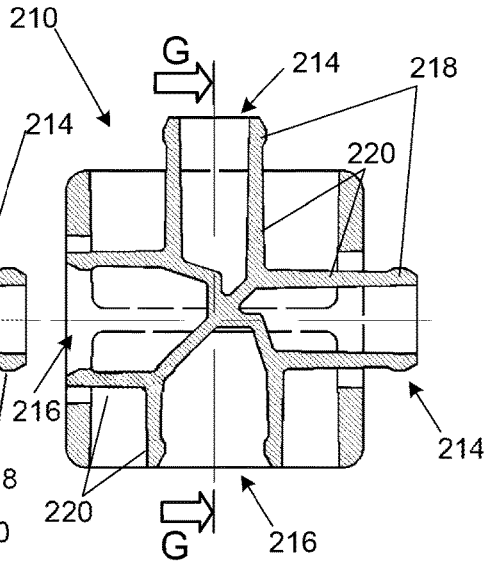
Figure 11:
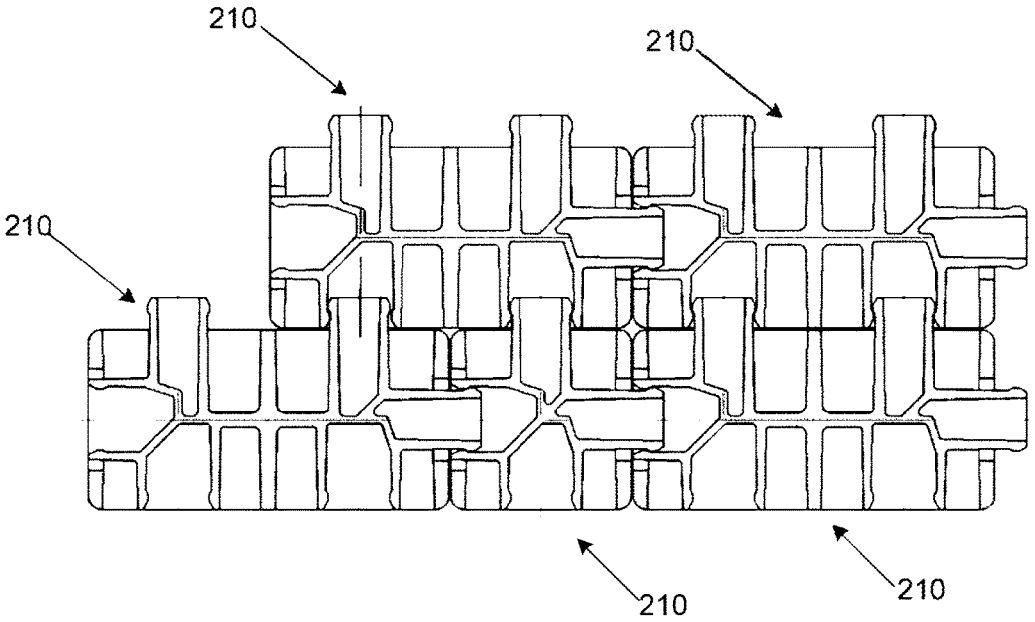
FIG. 11 is a sectional view of a plurality of interengaged elements, each element being in accordance with that of FIGS. 8, 9 and 10.
Figure 12:
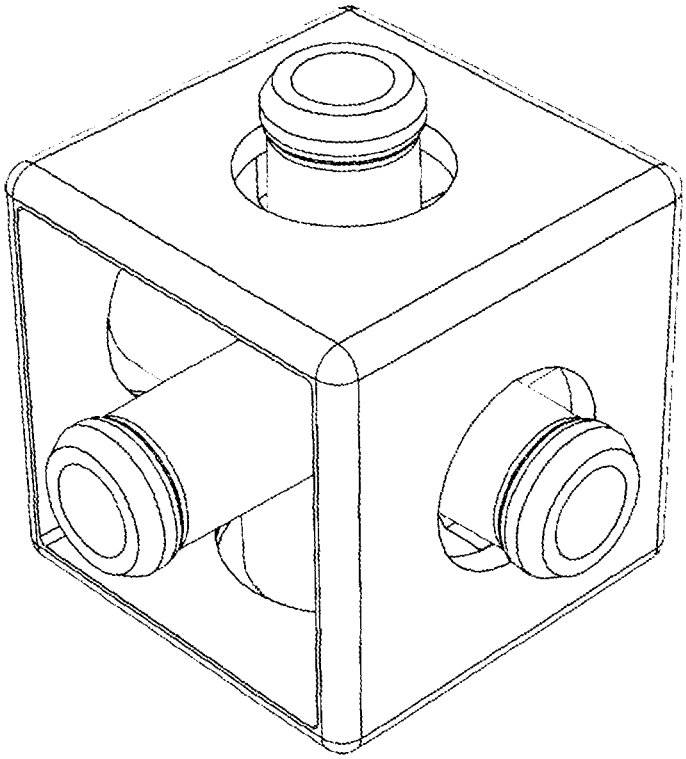
FIGS. 12 and 13 are perspective views of a toy construction element of another embodiment of the invention.
Figure 13:
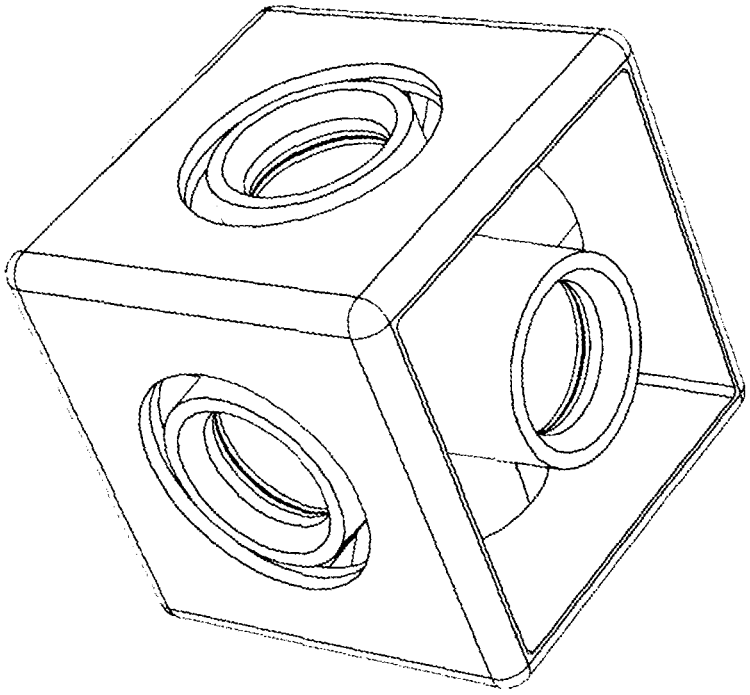
Figure 14:
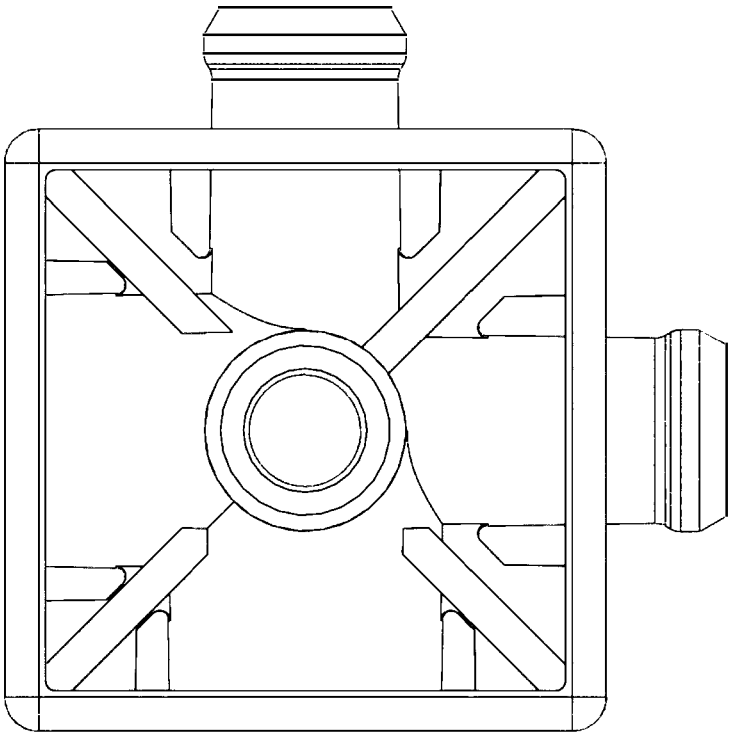
FIG. 14 is a front view of the element of FIGS. 12 and 13.
Figure 15:
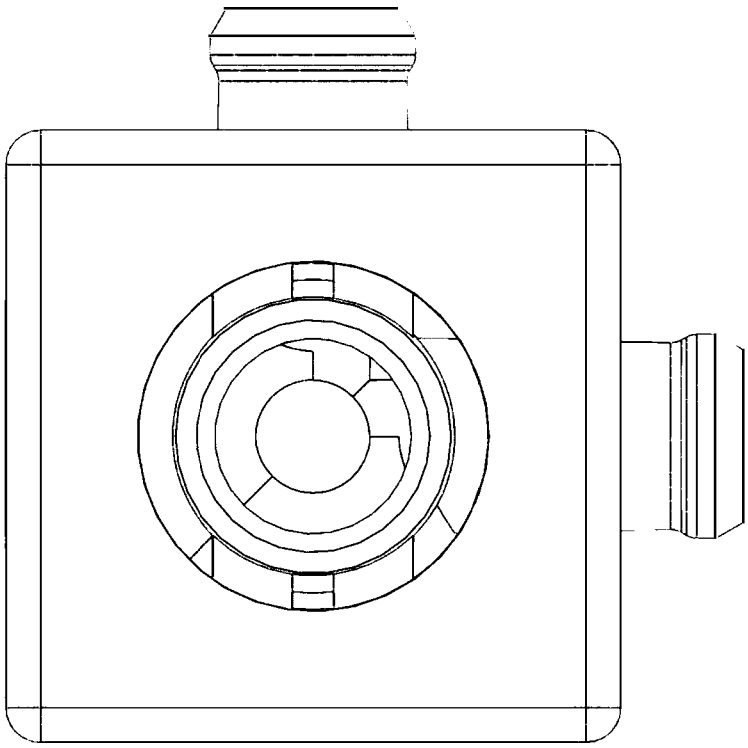
FIG. 15 is a left side view of the element of FIGS. 12 and 13.
Figure 16:
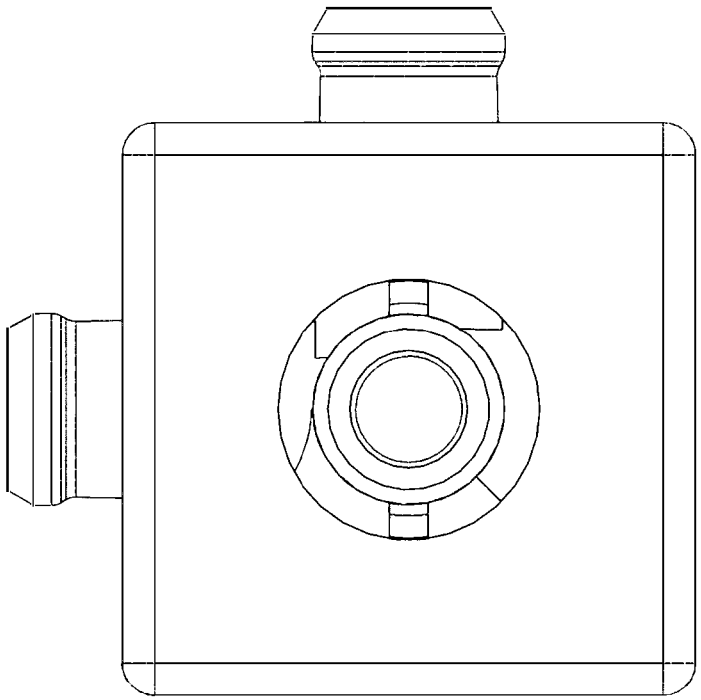
FIG. 16 is a right side view of the element of FIGS. 12 and 13.
Figure 17:
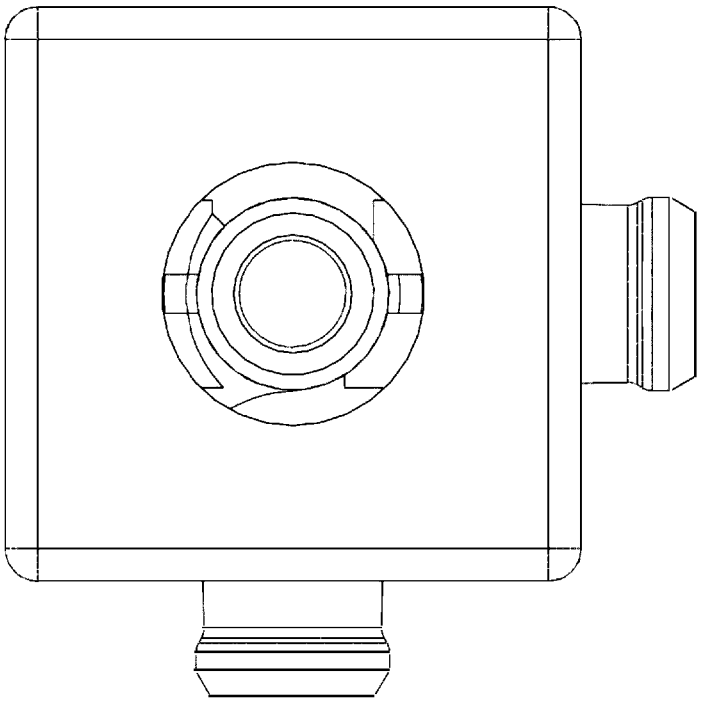
FIG. 17 is a top view of the element of FIGS. 12 and 13.
Figure 18:
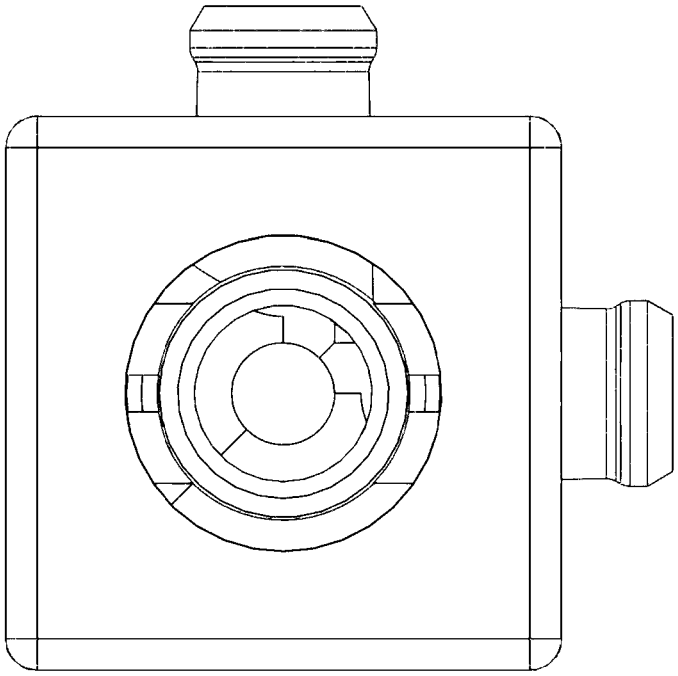
FIG. 18 is a bottom view of the element of FIGS. 12 and 13.
Figure 19:
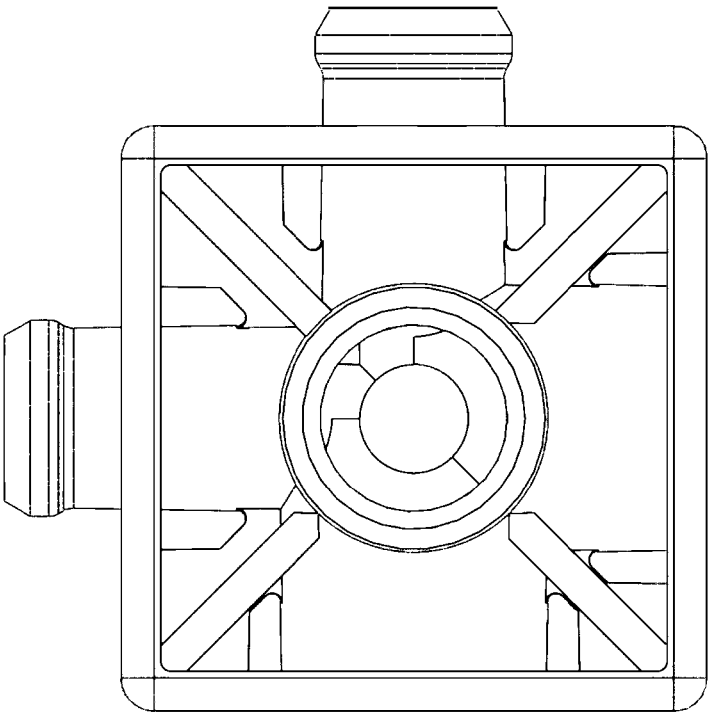
FIG. 19 is a rear view of the element of FIGS. 12 and 13.
Figure 20:
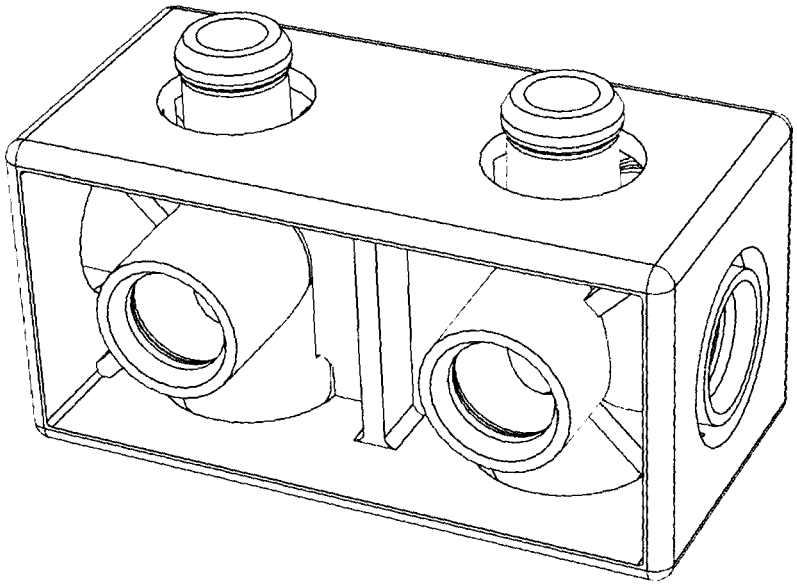
FIGS. 20 and 21 are perspective views of a toy construction element of another embodiment of the invention.
Figure 21:
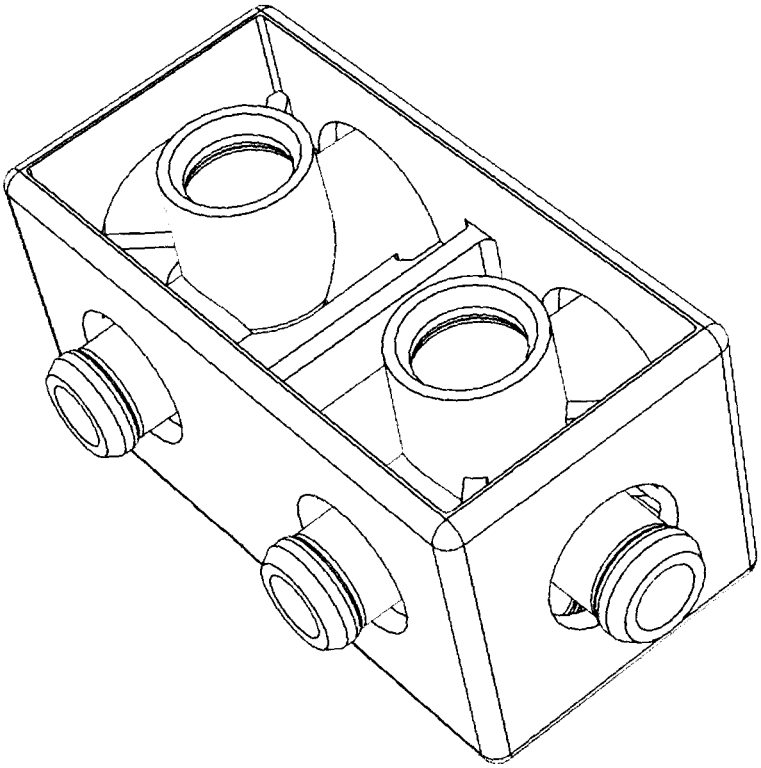
Figure 22:
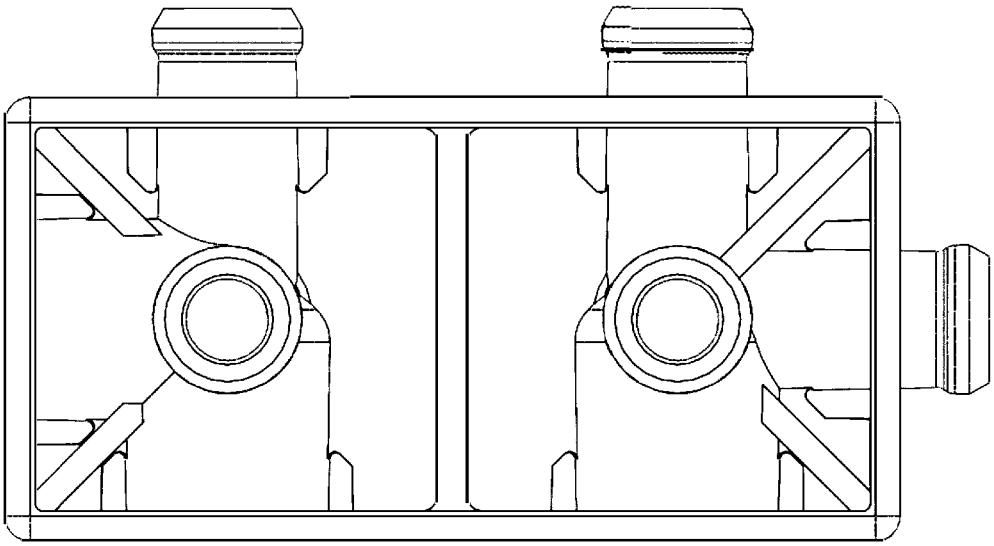
FIG. 22 is a front view of the element of FIGS. 20 and 21.
Figure 23:
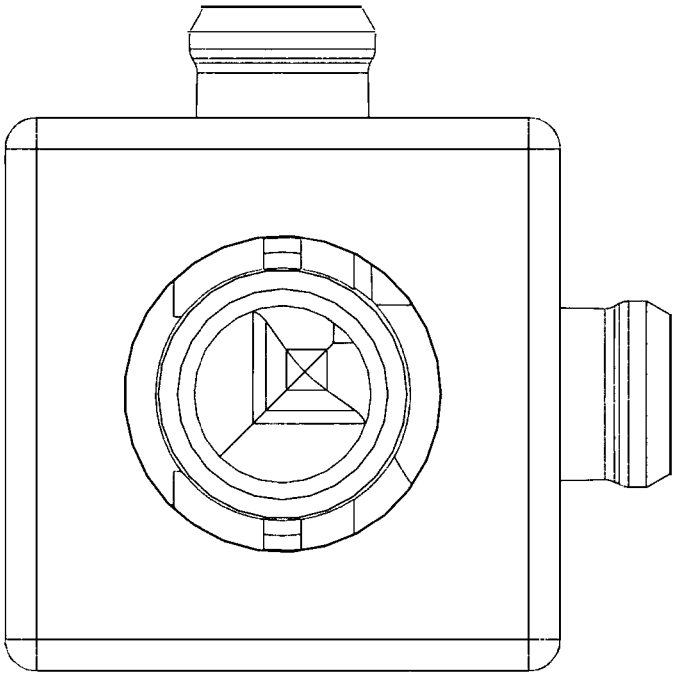
FIG. 23 is a left side view of the element of FIGS. 20 and 21.
Figure 24:
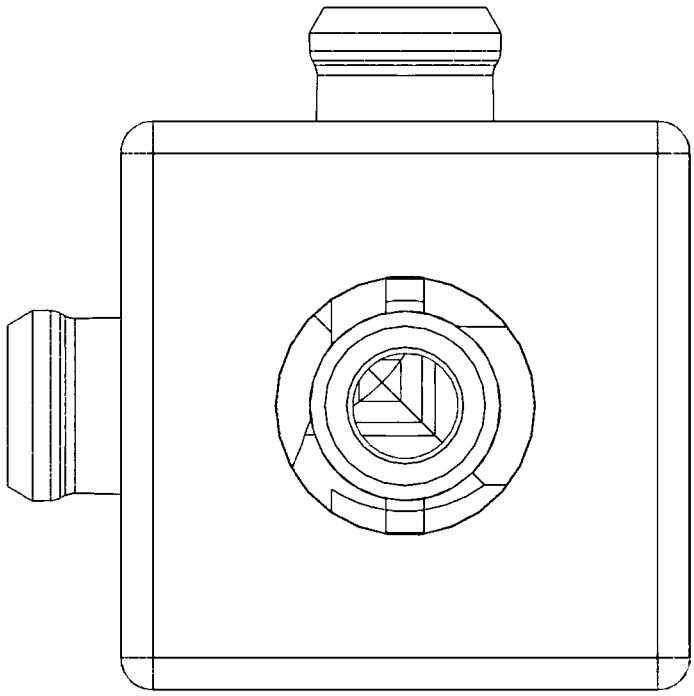
FIG. 24 is a right side view of the element of FIGS. 20 and 21.
Figure 25:
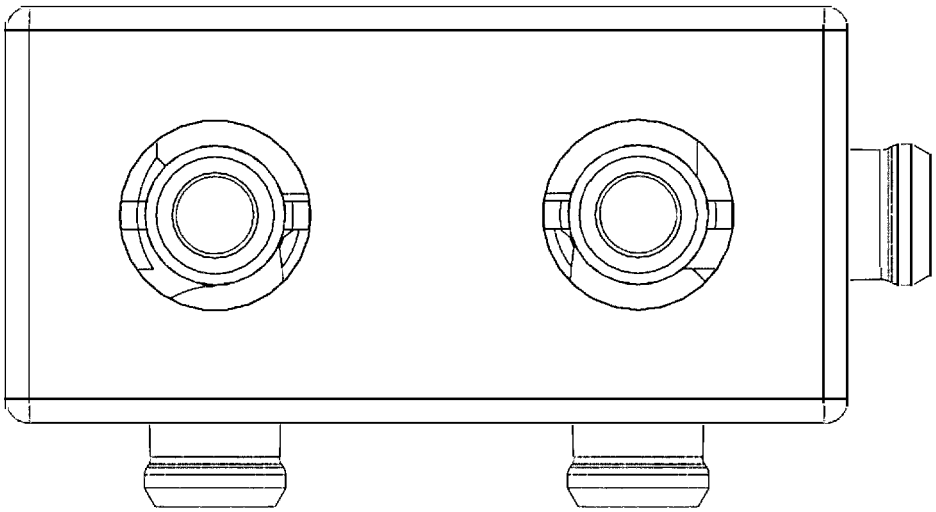
FIG. 25 is a top view of the element of FIGS. 20 and 21.
Figure 26:
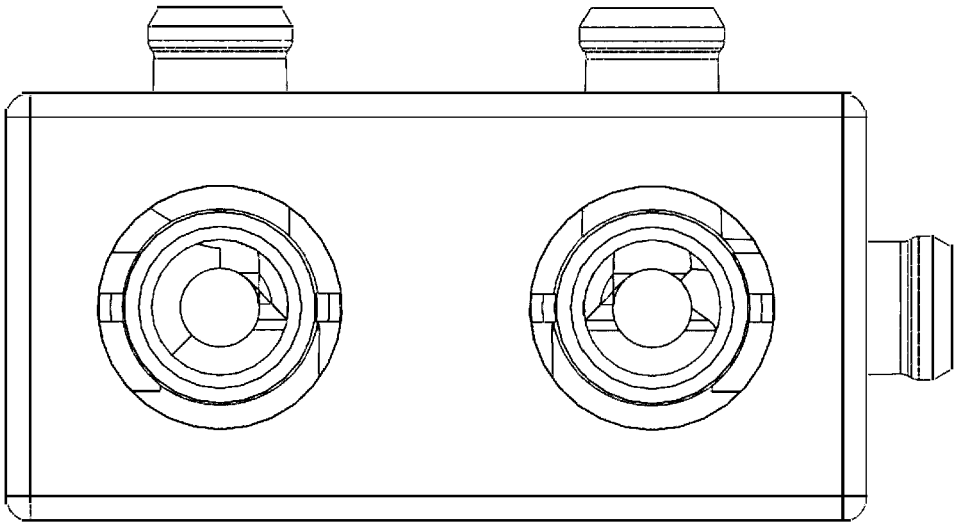
FIG. 26 is a bottom view of the element of FIGS. 20 and 21.
Figure 27:
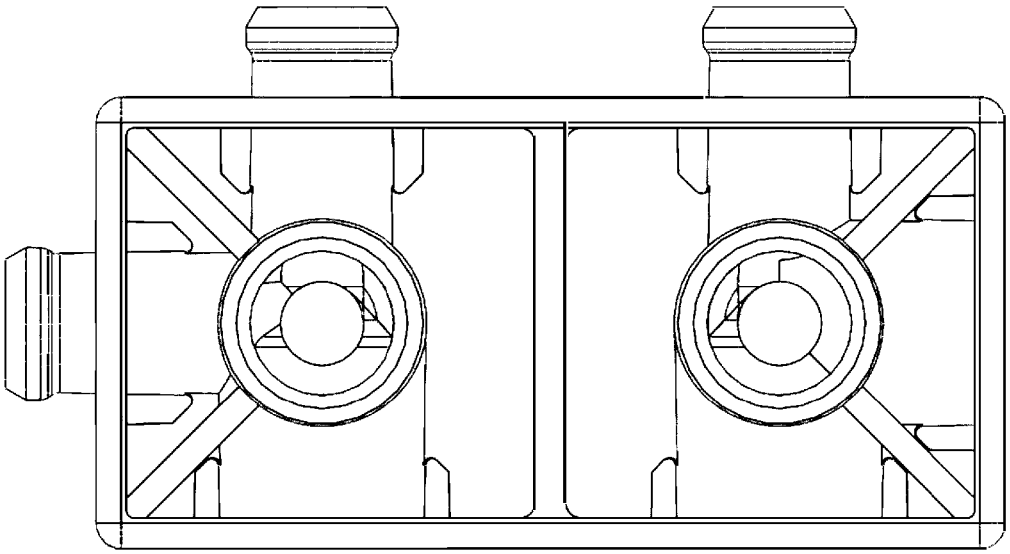
FIG. 27 is a rear view of the element of FIGS. 20 and 21.
Figure 28:
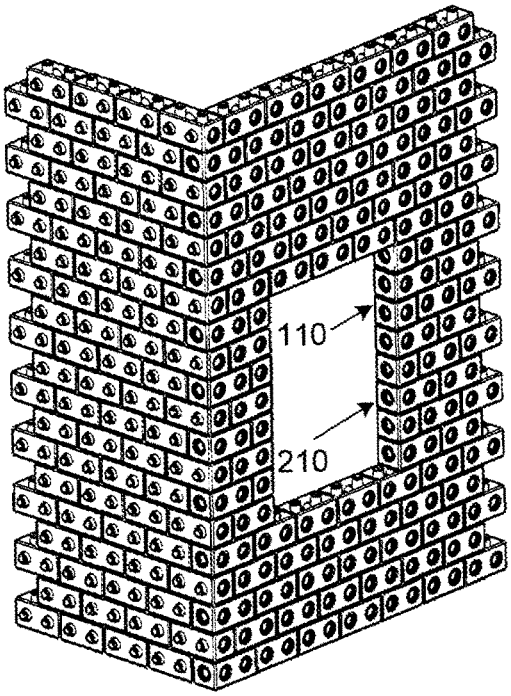
FIG. 28 is a 3D orthographic view of an assembly constructed from interengaged toy construction elements according to embodiments of the present invention.
Figure 29:
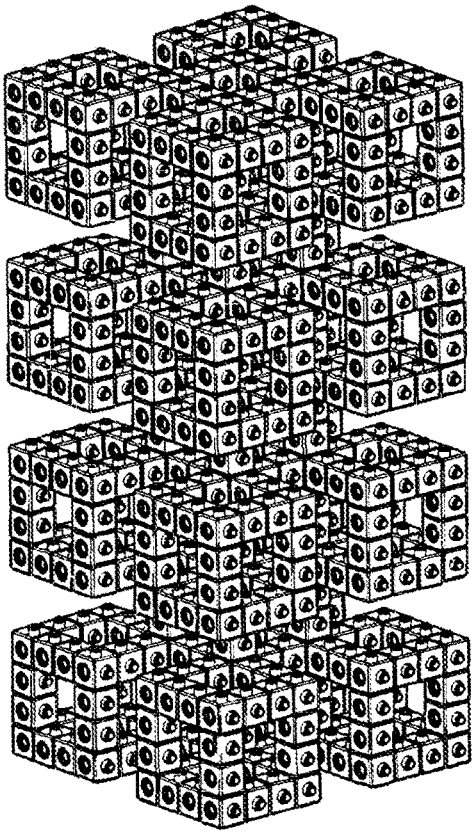
FIG. 29 is a 3D orthographic view of another assembly constructed from interengaged toy construction elements according to embodiments of the present invention.
Figure 30:
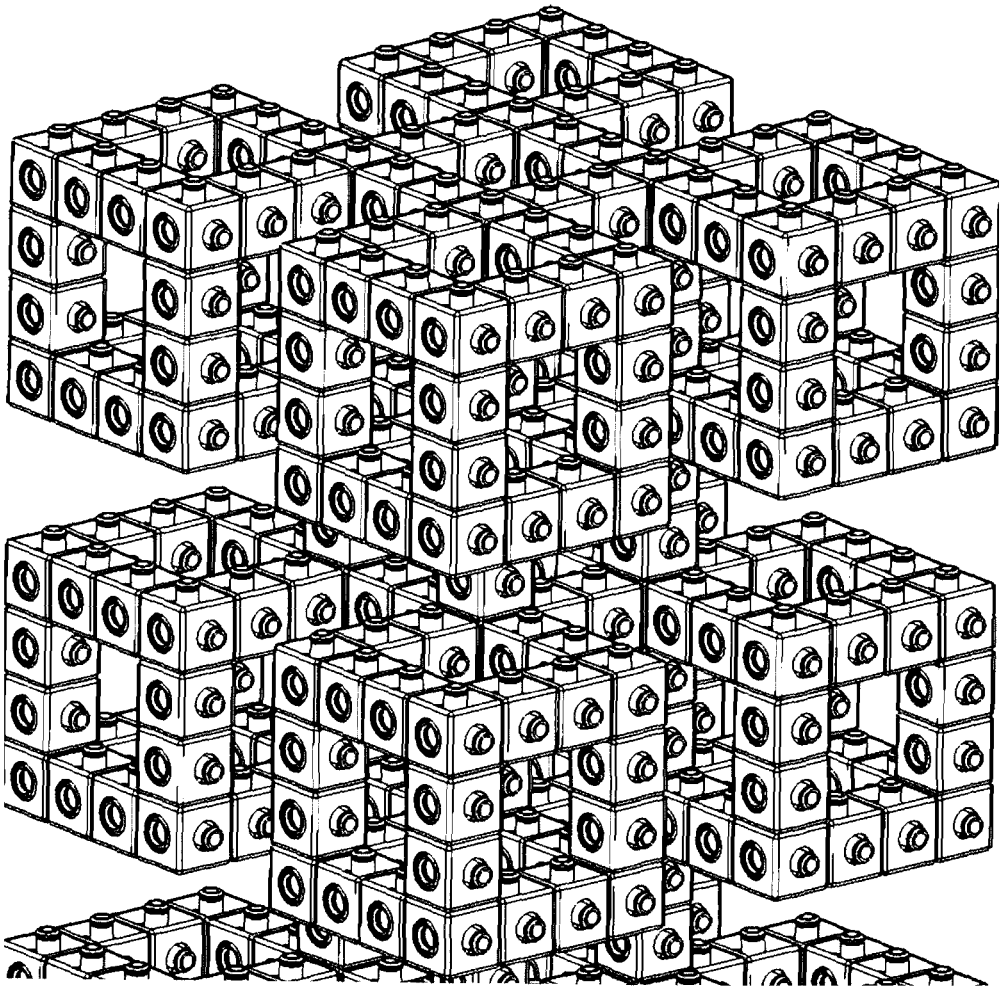
FIG. 30 is a close-up view of the assembly of FIG. 29.
Figure 31:
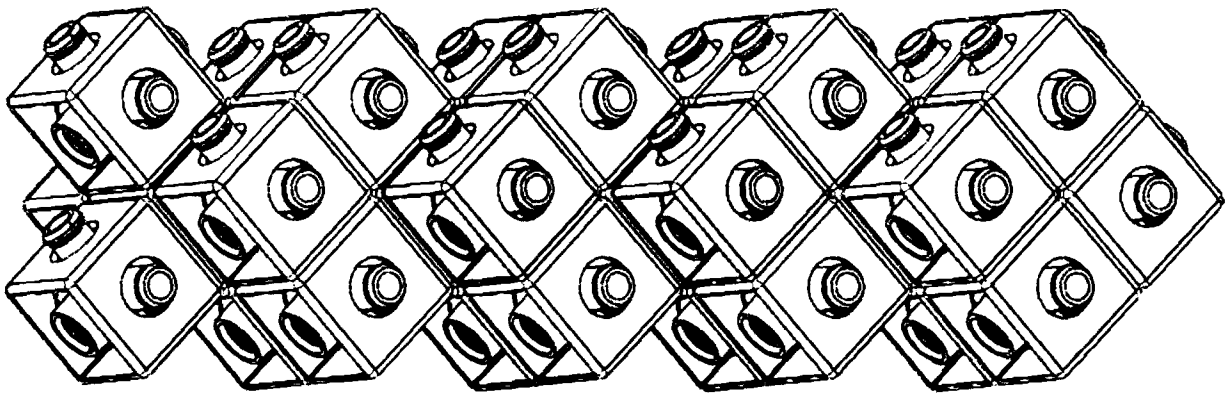
FIGS. 31 and 32 are 3D orthographic views of another assembly constructed from interengaged toy construction elements according to embodiments of the present invention.
Figure 32:
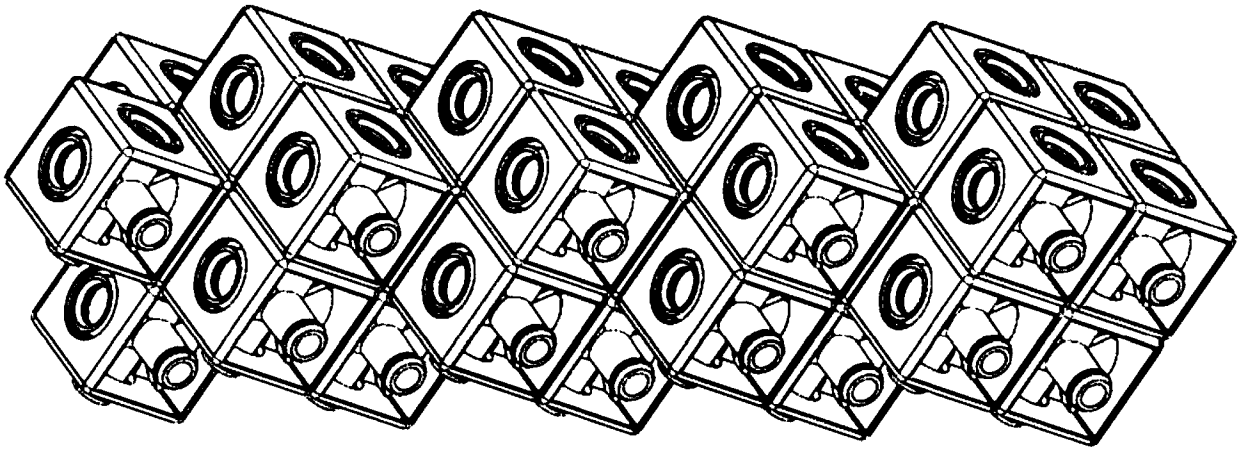

FIGS. 9 and 10 illustrate that the projections 214 and recesses 216 are configured as described above, and from FIG. 11 it can be seen that a plurality of elements 210 can also be interconnected or assembled into an assembly. Although illustrated as consisting of only elements 210, the construction may also include elements that are otherwise configured, such as elements 10, 110 described above. FIGS. 28 to 32 also show multiple elements according to embodiments of the invention interconnected or assembled into various constructions, for the purpose of exemplary illustration. The structure shown in FIG. 28, for example, illustrates a plurality of elements 110 and elements 210 interconnected together.

Although not illustrated, the above principles may be extended to construction elements that are generally of the size of three or more elements similar to those illustrated in FIG. 1.

The described embodiments are preferably formed of a thermoplastic material using injection moulding processes. By configuring the elements so that they are identical, the elements can be manufactured in volume, thereby greatly reducing manufacturing costs. Although a physical implementation of the invention has been described, it will be appreciated that it may also be implemented in a digital form via digital embodiments.

Digital embodiments may include videogames, a webpage, a computer game or a mobile phone app. It will be appreciated that in such embodiments, the method of assembling the elements may be virtually the same as, or similar to, the manner in which the elements are 10 physically assembled.

It is to be understood that references to "like" elements herein are references to any such elements of embodiments of the invention. It is thus of course possible, for example, for elements 10, 110, 210 to engage with one another.

The embodiments have been described by way of example only and modifications are possible within the scope of the invention disclosed. For example, although referred to as a construction toy, the described elements may be used in constructing structures that are complex and time consuming and not strictly considered a 'toy', Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as, an acknowledgement or admission or any form of suggestion that that prior publication (or information derived from it) or known matter forms part of the common general knowledge in the field of 30 endeavour to which this specification relates.

REFERENCE NUMERALS

10 toy construction element
12 body
14 projection
16 recess
18 bulge
20 resilient component
110 toy construction element
112 body
114 projection
116 recess
118 bulge
120 resilient component
210 toy construction element
212 body
214 projection
216 recess
218 bulge
220 resilient component

The invention claimed is:

1. A toy construction element comprising:

a body with at least one projection extending therefrom and a plurality of complementary-shaped recesses formed therein, the body comprising planar sides, the at least one projection and the recesses each being at least partially defined by a hollow, elongate, and resilient cylindrical wall, the cylindrical walls extending outwardly from a common interior location of the body along at least two different axes, each recess of the plurality of recesses being configured for receiving a corresponding projection from a like toy construction element so as to allow like toy construction elements to be interconnected in three dimensions, the at least one projection and the recesses being formed with snap-fit interlocking features for interlocking engagement between like toy construction elements, the snap-fit interlocking features including complementary locking formations formed on the at least one projection and the recesses, wherein the complementary locking formations comprise an annular bulge extending outwardly from an outer surface of the at least one projection near a distal end thereof, and an annular bulge extending inwardly from an inner surface of each recess near respective distal ends thereof, during insertion of a projection of one toy construction element into a recess of a like toy construction element, the inserted projection is configured to resiliently flex inwardly and the corresponding recess is configured to resiliently flex outwardly to permit the respective bulges thereof to pass over each other to enable interconnection of the toy construction elements, and the resilient cylindrical wall of at least one recess of the plurality of recesses extends from the common interior location of the body to a level of one of the planar sides of the body and is spaced therefrom by a continuous ring-shaped space provided radially outward of at least a distal end of the resilient cylindrical wall such that the resilient cylindrical wall is permitted to resiliently flex into the continuous space to permit passage of the bulges during assembly and disassembly of like toy construction elements.

2. A toy construction element according to claim 1, configured so that the respective resilient cylindrical walls of the at least one projection and the recesses are stressed as the bulges pass over each other and relieved of stress otherwise when like elements are interconnected.

3. A toy construction element according to claim 1, wherein the toy construction element is in the form of a unit-shape comprising at least one of a cuboid, a parallelepiped, a sphere, a prism, a cone, a cylinder, or a torus.

4. A toy construction element according to claim 3, wherein the body of the toy construction element is formed as an integration of a plurality of said unit-shapes.

5. A toy construction element according to claim 1, wherein the body of the toy construction element is formed of a plurality of integrally formed cuboid unit-shapes, each external surface of each cuboid unit-shape having a projection or recess formed thereon.

6. A non-transitory computer-readable medium configured to store a toy construction element according to claim 1 represented in a digital form.

7. A toy construction element according to claim 6, implemented by computer software executed on a fixed, portable and/or hand-held computing device.

* * * * *